US005695666A

United States Patent [19]

Nagata et al.

[11] Patent Number: 5,695,666

[45] Date of Patent: Dec. 9, 1997

[54] METHOD OF WELDING NEUTRON IRRADIATED METALLIC MATERIAL

[75] Inventors: Tetsuya Nagata; Yasuhisa Aono; Jun'ya Kaneda, all of Hitachi; Takahiko Kato, Hitachinaka, all of Japan

[73] Assignee: Hitachi, Ltd., Tokyo, Japan

[21] Appl. No.: 492,612

[22] Filed: Jun. 20, 1995

[30] Foreign Application Priority Data

Jun. 22, 1994 [JP] Japan ..... 6-139917

[51] Int. Cl.[6] ..... B23K 9/00

[52] U.S. Cl. ..... 219/137 WM; 228/232

[58] Field of Search ..... 219/137 WM, 219/137 R; 148/903; 228/203, 226, 232; 376/305

[56] References Cited

U.S. PATENT DOCUMENTS

| | | | |
|---|---|---|---|
| 4,049,186 | 9/1977 | Hanneman et al. | 219/137 WM |
| 4,234,119 | 11/1980 | Masaoka et al. | 219/137 R |
| 4,247,037 | 1/1981 | Tamai et al. | 228/203 |
| 4,624,402 | 11/1986 | Pitcairn et al. | 228/226 |
| 5,018,706 | 5/1991 | Butler et al. | 266/124 |
| 5,022,936 | 6/1991 | Tsujimura et al. | 148/903 |
| 5,305,361 | 4/1994 | Enomoto et al. | 376/305 |

FOREIGN PATENT DOCUMENTS

| | | |
|---|---|---|
| 62-63614 | 9/1987 | Japan . |
| 3-170093 | 7/1991 | Japan . |
| 4-362124 | 12/1992 | Japan . |
| 5-65530 | 3/1993 | Japan . |

*Primary Examiner*—Clifford C. Shaw

*Attorney, Agent, or Firm*—Antonelli, Terry, Stout, & Kraus, LLP

[57] ABSTRACT

In a case of welding a highly neutron-irradiated austenitic stainless steel, the portion to be welded is heated under a condition of temperature and time in a predetermined range before welding. In this moment, chromium carbide ($Cr_{23}C_6$) precipitates in the grain boundaries of the stainless steel. Welding is performed the state described above is obtained. Since, chromium carbide has been precipitated in the grain boundary by the heat treatment before welding, any helium atoms generated through nucleus conversion of Ni, are apt to be trapped with the chromium carbide, thereby reducing the number of gas bubbles formed by gathering the helium atoms in the grain boundaries. As a result, since decrease in the strength of the grain boundaries due to helium gas bubbles is moderated, it is possible to prevent occurrence of cracks during welding.

9 Claims, 3 Drawing Sheets

METHOD OF WELDING NEUTRON IRRADIATED METALLIC MATERIAL

BACKGROUND OF THE INVENTION

The present invention relates to a method of welding a neutron irradiated metallic material and more particularly relates to a method of welding neutron irradiated austenitic stainless steel.

There is concern about deterioration occurring with time in a material of component placed in a high temperature and high pressure environment and irradiated with neutrons.

It is thought that the deterioration with time is caused by change in structure of the metallic material composing the component or change in local composition in the metallic material, and induces stress corrosion cracking.

That is, stress corrosion cracking is caused by the combination of the following factors: deterioration of the material itself over time and radiation damage accelerating the deterioration with time; stress loading on the material; and the high temperature, high pressure, water corrosive environment.

As a method of preventing occurrence of cracking due to deterioration with time, a method of removing the deterioration factor of the material itself against occurrence of cracking has been developed. That is, a technology is disclosed in Japanese Patent Application Laid-Open No.3-170093 (1991), where a different material having resistivity against stress corrosion cracking is melted into the surface portion of a component to be deteriorated with time through a non-filler tungsten inert gas welding method. A technology is disclosed in Japanese Patent Application Laid-Open No.5-65530 (1993), where causes of stress corrosion cracking, that is, change in structure of the metallic material composing the component and change in local composition in the metallic material are removed by melting and freezing the surface portion to be deteriorated with time.

Japanese Patent Application Laid-Open No.62-63614 (1987) and Japanese Patent Application Laid-Open No.4-362124 (1992) disclose a method where the stress factor having been loaded to a metallic material of a component employed in a nuclear reactor before the servicing term of the nuclear reactor, especially, tensile remaining stress caused in a welded portion before the servicing term of the nuclear reactor, is removed.

In this method, the metallic material composing a component deteriorated with time is set in an atmospheric or a water environment, and a high speed water jet from a nozzle is collided against the surface of the metallic material to yield compressive stress in the surface of the metallic material. Therewith, the tensile remaining stress is removed so that stress corrosion cracking is hardly caused.

However, in the technology where a different material having resistivity against stress corrosion cracking is melted into the surface portion of a component to be deteriorated with time through the non-filler tungsten inert gas welding method, among the above conventional technologies, cracks occurred during the servicing period of a structure or a component can be neither removed nor recovered.

In the method where stress factor having been loaded to a metallic material of a component employed in a nuclear reactor before the servicing term of the nuclear reactor, especially, tensile remaining stress caused in a welded portion before the servicing term of the nuclear reactor, is removed, there is an effect in that occurrence of stress corrosion cracking can be deferred since the stress factor is decreased by performing the work before the servicing term of the structure or the component even if the metallic material is deteriorated with time.

Further, by applying the above method even in a stage where cracks or hair cracks, that is first stage of cracks, appear on the surface of a metallic material due to deterioration with time during servicing period of a nuclear reactor, there is an effect in that progress of the cracks or the hair cracks is decreased. However, in this method, the cracks produced during the servicing period of the structure or the component cannot be removed or recovered.

On the other hand, in recent years, it is clarified from a test result of welding of neutron irradiated stainless steel or neutron irradiation simulated stainless steel, that the strength of the grain boundaries is decreased and cracks are apt to occur during welding since helium atoms, which are nucleus exchange yield of nickel nucleuses in stainless steel, are gathered in grain boundaries due to welding heat during welding of highly neutron-irradiated stainless steel.

That is, only when the above conventional technologies are applied to the material of a component installed in a high temperature and high pressure water environment and irradiated with neutrons before the material is not deteriorated with time, do the technologies display the effect to prevent occurrence of cracking with time. However, cracks once produced cannot be removed or recovered.

Although it is considered to perform welding in order to remove or recover such cracks once produced, there is a problem in that the strength of the grain boundaries is decreased and cracks are apt to occur during welding since helium atoms, which are nucleus exchange yield of nickel nucleuses in stainless steel, are gathered to form bubbles in grain boundaries due to welding heat during welding of highly neutron-irradiated stainless steel, as described above.

As a result, it is required to develop a welding method which is capable of welding a neutron irradiated metallic material without causing any cracks during welding.

Therefore, the first object of the present invention is to provide a welding method which is capable of applying welding to a neutron-irradiated component made of an austenitic stainless steel without causing any cracks during welding.

The second object of the present invention is to prevent occurrence of cracks during application of welding to a neutron-irradiated component made of an austenitic stainless steel without causing any cracks during welding, and to improve the resistivity in the welded portion of the austenitic stainless steel after welding against deterioration with time under a high temperature and high pressure environment, and a neutron irradiation environment.

SUMMARY OF THE INVENTION

The first invention to attain the first object of the present invention is characterized by that, in a method of welding a structure and a component made of stainless steel type SUS 304 having a carbon content C of 0.08 wt %≧C>0.03 wt %, the method of welding the neutron-irradiated metallic material comprising the steps of heating the whole portion or a proper portion of the structure and the component deteriorated by neutron irradiation under a condition of a temperature and a time, the temperature being larger than and the time being larger than a temperature-time line obtained by successively connecting with straight segments between coordinate points on a temperature-time coordinate system of (700° C., $1\times10^3$ seconds), (650° C., $5\times10^4$ seconds), (650° C., $1\times10^4$ seconds), (600° C., $5\times10^4$ seconds) and (600° C., $1\times10^6$ seconds), and the temperature being smaller than and the time being larger than a temperature-time line obtained by successively connecting with straight segments between coordinate points of (750° C., $1\times10^3$ seconds), (800° C., $5\times10^3$ seconds), (800° C., $1\times10^6$ seconds), and after cooling, performing welding of the whole portion or the proper portion of the structure and the component.

The second invention to attain the first object of the present invention is characterized by that, in a method of welding a structure and a component made of stainless steel type SUS 304L having a carbon content C of 0.03 wt %≧C>0.02 wt %, the method of welding the neutron-irradiated metallic material comprising the steps of heating the whole portion or a proper portion of the structure and component deteriorated by neutron irradiation under a condition of a temperature and a time, the temperature being larger than and the time being larger than a temperature-time line obtained by successively connecting with straight segments between coordinate points on a temperature-time coordinate system of (700° C., $5\times10^3$ seconds), (650° C., $1\times10^4$ seconds), (650° C., $5\times10^4$ seconds), (600° C., $1\times10^5$ seconds) and (600° C., $1\times10^6$ seconds), and the temperature being smaller than 700° C., and after cooling, performing welding of the whole portion or the proper portion of the structure and the component.

The third invention to attain the first object of the present invention is characterized by that, in a method of welding a structure and a component made of stainless steel type SUS 304L having a carbon content C of 0.02 wt %≧C>0 wt %, the method of welding the neutron-irradiated metallic material comprising the steps of heating the whole portion or a proper portion of the structure and component deteriorated by neutron irradiation under a condition of a temperature and a time, the temperature being larger than and the time being larger than a temperature-time line obtained by successively connecting with straight segments between coordinate points on a temperature-time coordinate system of (650° C., $5\times10^4$ seconds), (700° C., $1\times10^5$ seconds) and (700° C., $1\times10^6$ seconds), and the temperature being larger than 650° C., and after cooling, performing welding of the whole portion or the proper portion of the structure and the component.

The fourth invention to attain the first object of the present invention is characterized by that, in a method of welding a structure and a component made of stainless steel type SUS 316L having a carbon content C of 0.03 wt %≧C>0.02 wt %, the method of welding the neutron-irradiated metallic material comprising the steps of heating the whole portion or a proper portion of the structure and component deteriorated by neutron irradiation under a condition of a temperature and a time, the temperature being larger than and the time being larger than a temperature-time line obtained by successively connecting with straight segments between coordinate points on a temperature-time coordinate system of (750° C., $5\times10^3$ seconds), (700° C., $1\times10^4$ seconds), (650° C., $5\times10^4$ seconds), and (650° C., $1\times10^6$ seconds), and the temperature being smaller than 750° C., and after cooling, performing welding of the whole portion or the proper portion of the structure and the component.

The fifth invention to attain the first object of the present invention is characterized by that, in a method of welding a structure and a component made of stainless steel type SUS 316L having a carbon content C of 0.02 wt %≧C>0 wt %, the method of welding the neutron-irradiated metallic material comprising the steps of heating the whole portion or a proper portion of the structure and component deteriorated by neutron irradiation under a condition of a temperature and a time, the temperature being larger than and the time being larger than a temperature-time line obtained by successively connecting with straight segments between coordinate points on a temperature-time coordinate system of (750° C., $1\times10^5$ seconds), (700° C., $1\times10^5$ seconds) and (650° C., $1\times10^6$ seconds), and the temperature being smaller than 750° C., and after cooling, performing welding of the whole portion or the proper portion of the structure and the component.

The sixth invention to attain the second object of the present invention is characterized in that, in the method of welding the neutron-irradiated metallic material according to any one of the first invention to the fifth invention described above, after completion of the welding, pressure is applied to the surface of heated portion including the welded portion and the vicinity of the welded portion to add compressive remaining stress or decrease tensile remaining stress.

The seventh invention to attain the second object of the present invention is characterized in that, in the method of welding the neutron-irradiated metallic material according to the sixth invention, the pressure applying is performed by placing a water jet nozzle in a position facing to the surface of heated portion and collide a high speed jet flow containing gas bubbles from the water jet nozzle against the surface of heated portion.

The eighth invention to attain the second object of the present invention characterized in that, in the method of welding the neutron-irradiated metallic material according to any one of the first invention to the fifth invention described above, after completion of the welding, the surface of heated portion including the welded portion and the vicinity of the welded portion undergoes a solution treatment by reheating to diffuse chromium carbide precipitated in the grain boundaries of the metal structure.

The ninth invention to attain the second object of the present invention is characterized in that, in the method of welding the neutron-irradiated metallic material according to the eighth invention, the reheating is performed through non-filler tungsten inert gas welding or irradiation of high energy beams.

DETAILED DESCRIPTION OF THE PREFERRED EMBODIMENTS

The first embodiment of the present invention will be described below, referring to FIG. 1.

Chemical components of a austenitic stainless steel of type SUS 304 are C≦0.08 wt %, Si≦1.00 wt %, Mn≦2.00 wt %, P≦0.045 wt %, S≦0.030 wt %, 8.00 wt %≦Ni≦10.50 wt %, 18.00≦Cr≦20.00 wt %.

A stainless steel of type SUS 304 having a carbon (C) content of 0.08 wt %≧C>0.03 wt % has been heated with varying temperature and time, and then the corrosion resistivity of the stainless steel of type SUS 304 has been studied by the Strauss testing method. The results are plotted in FIG. 1.

The Strauss testing method is a corrosion testing method for stainless steel using sulfuric acid copper sulfate (testing method of JIS G 575), in which a test piece of an austenitic stainless steel is immersed in a boiling aqueous solution of sulfuric acid and copper sulfate, and then cracks caused by a bending test are observed to judge the degree of grain boundary corrosion.

Figure 1:
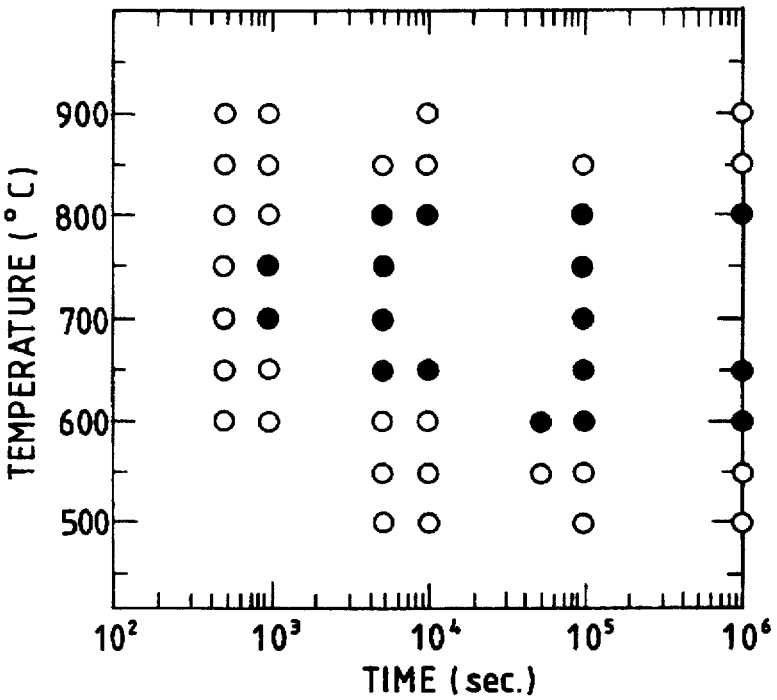
FIG. 1 is a graph showing a result of a Strauss test of a metallic material applied with a heat treatment before welding in the first embodiment in accordance with the present invention.

In FIG. 1, a hollow circle indicates a case where no crack is observed, and a solid circle indicates a case where cracks are observed.

Here, the case of occurrence of cracks suggests decreasing of the corrosion resistivity in the vicinity of grain boundaries due to precipitation of chromium carbide in the grain boundaries.

In this embodiment, using the test results shown in FIG. 1, chromium carbide is precipitated in the grain boundaries by heating the stainless steel of type SUS 304 under the following heating condition of temperature and time before performing welding.

The heating condition of temperature and time is that the temperature is larger than and the time is larger than a temperature-time line obtained by successively connecting with straight segments between coordinate points on a temperature-time coordinate system shown in FIG. 1 of (700° C., $1\times10^3$ seconds), (650° C., $5\times10^4$ seconds), (650° C., $1\times10^4$ seconds), (600° C., $5\times10^4$ seconds) and (600° C., $1\times10^6$ seconds), and the temperature being smaller than and the time is larger than a temperature-time line obtained by successively connecting with straight segments between coordinate points of (750° C., $1\times10^3$ seconds), (800° C., $5\times10^3$ seconds), (800° C., $1\times10^6$ seconds).

Chromium carbide is precipitated in the grain boundaries of the stainless steel of type SUS 304 before performing welding by heating the stainless steel of type SUS 304 under such a condition described above, and then the stainless steel of type SUS 304 is welded. By doing so, occurrence of cracks can be prevented in a manner to be explained below.

That is, in a case of welding a highly neutron-irradiated austenitic stainless steel of type SUS 304, the portion to be welded is heated under a condition of temperature and time in the range described above before welding.

With the heating, chromium carbide ($Cr_{23}C_6$) precipitates in the grain boundaries of the stainless steel of type SUS 304.

Helium atoms are generated in the austenitic stainless steel through nucleus conversion of Ni, a component of stainless steel of type SUS 304, irradiated with neutrons.

However, the generated helium atoms cannot move because the helium atoms are trapped by dislocations and vacancies generated inside the grain by irradiation of neutrons.

The portion to be welded is welded after the state described above is formed.

When the temperature of the stainless steel becomes above 800° C. during welding, the helium atoms start to move since the dislocations and the vacancies are recovered.

However, chromium carbide has been precipitated in the grain boundary by the heat treatment before welding and helium atoms are apt to be trapped with the chromium carbide.

Therefore, the size and the number of gas bubbles formed by gathering the helium atoms in the grain boundaries themselves are relatively decreased.

As the result, since the decrease in the strength of the grain boundaries due to helium gas bubbles is moderated, it is possible to prevent occurrence of cracks due to tensile stress generated in the vicinity of welded portion after welding.

The second embodiment of the present invention will be described below, referring to FIG. 2.

Chemical components of a austenitic stainless steel of type SUS 304L are C≦0.030 wt %, Si≦1.00 wt %, Mn≦2.00 wt %, P≦0.045 wt %, S≦0.030 wt %, 9.00 wt %≦Ni≦13.00 wt %, 18.00≦Cr≦20.00 wt %.

A stainless steel of type SUS 304L having a carbon (C) content of 0.03 wt %≧C>0.02 wt % has been heated with varying temperature and time, and then the corrosion resistivity of the stainless steel of type SUS 304L has been studied by the Strauss testing method. The results are plotted in FIG. 2.

Figure 2:
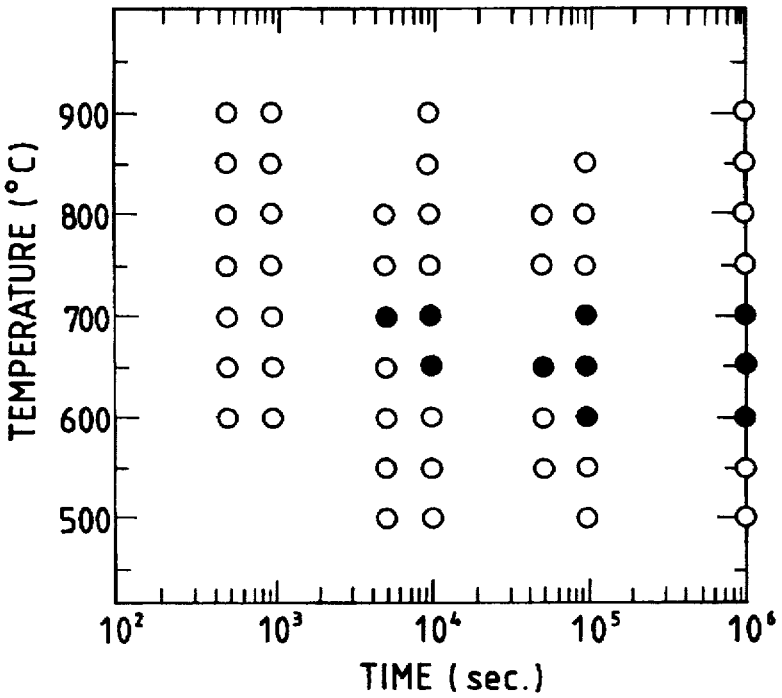
FIG. 2 is a graph showing a result of a Strauss test of a metallic material applied with a heat treatment before welding in the second embodiment in accordance with the present invention.

In FIG. 2, a hollow circle indicates a case where no crack is observed in the stainless steel of type SUS 304L, and a solid circle indicates a case where cracks are observed.

Here, the case of occurrence of cracks suggests decreasing of the corrosion resistivity in the vicinity of grain boundaries due to precipitation of chromium carbide in the grain boundaries.

In this embodiment, using the test results shown in FIG. 2, chromium carbide is precipitated in the grain boundaries by heating the stainless steel of type SUS 304L under the following heating condition of temperature and time before performing welding.

The heating condition of temperature and time is that the temperature is larger than and the time is larger than a temperature-time line obtained by successively connecting with straight segments between coordinate points on a temperature-time coordinate system shown in FIG. 2 of (700° C., $5\times10^3$ seconds), (650° C., $1\times10^4$ seconds), (650° C., $5\times10^4$ seconds), (600° C., $1\times10^5$ seconds) and (600° C., $1\times10^6$ seconds), and the temperature is smaller than 700° C.

Chromium carbide is precipitated in the grain boundaries of the stainless steel of type SUS 304L before performing welding by heating the stainless steel of type SUS 304L under such a condition described above, and then the stainless steel of type SUS 304L is welded. By doing so, occurrence of cracks can be prevented in the same manner as explained in the first embodiment.

The third embodiment of the present invention will be described below, referring to FIG. 3.

A stainless steel of type SUS 304L having a carbon (C) content of 0.02 wt %≧C>0.00 wt % has been heated with varying temperature and time, and then the corrosion resistivity of the stainless steel of type SUS 304L has been studied by the Strauss testing method. The results are plotted in FIG. 3.

Figure 3:
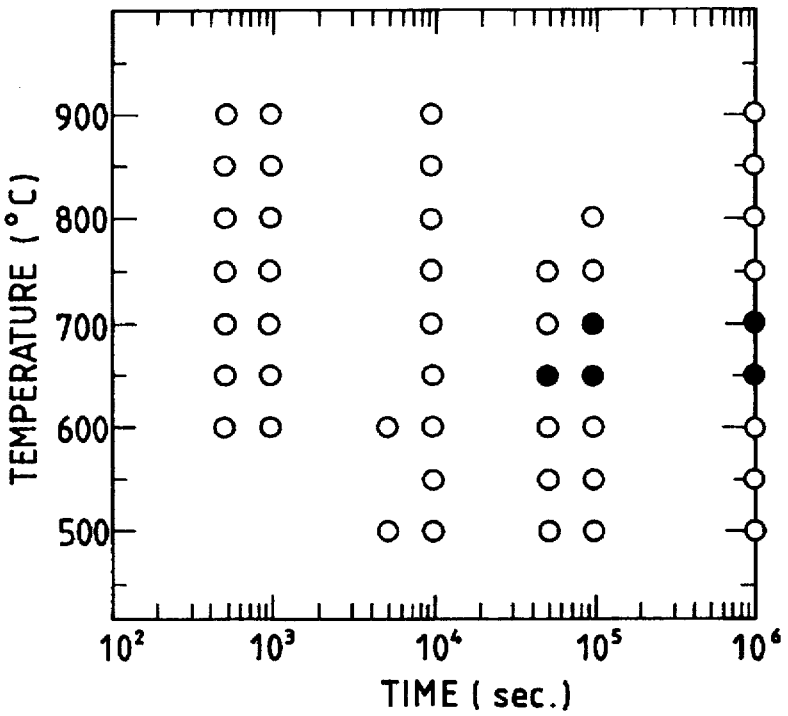
FIG. 3 is a graph showing a result of a Strauss test of a metallic material applied with a heat treatment before welding in the third embodiment in accordance with the present invention.

In FIG. 3, a hollow circle indicates a case where no crack is observed in the stainless steel of type SUS 304L, and a solid circle indicates a case where cracks are observed.

Here, the case of occurrence of cracks suggests decreasing of the corrosion resistivity in the vicinity of grain boundaries due to precipitation of chromium carbide in the grain boundaries.

In this embodiment, using the test results shown in FIG. 3, chromium carbide is precipitated in the grain boundaries by heating the stainless steel of type SUS 304L under the following heating condition of temperature and time before performing welding.

The heating condition of temperature and time is that the temperature is larger than and the time is larger than a temperature-time line obtained by successively connecting with straight segments between coordinate points on a temperature-time coordinate system shown in FIG. 3 of (650° C., $5\times10^4$ seconds), (700° C., $1\times10^5$ seconds) and (700° C., $1\times10^6$ seconds), and the temperature is smaller than 650° C.

Chromium carbide is precipitated in the grain boundaries of the stainless steel of type SUS 304L before performing welding by heating the stainless steel of type SUS 304L under such a condition described above, and then the stainless steel of type SUS 304L is welded. By doing so, occurrence of cracks can be prevented in the same manner as explained in the first embodiment.

The fourth embodiment of the present invention will be described below, referring to FIG. 4.

Chemical components of a austenitic stainless steel of type SUS 316L are $C\leqq0.030$ wt %, $Si\leqq1.00$ wt %, $Mn\leqq2.00$ wt %, $P\leqq0.045$ wt %, $S\leqq0.030$ wt %, 12.00 wt $\%\leqq Ni\leqq15.00$ wt %, $16.00\leqq Cr\leqq18.00$ wt %.

A stainless steel of type SUS 316L having a carbon (C) content of 0.03 wt $\%\leqq C>0.02$ wt % has been heated with varying temperature and time, and then the corrosion resistivity of the stainless steel of type SUS 316L has been studied by the Strauss testing method. The results are plotted in FIG. 4.

Figure 4:
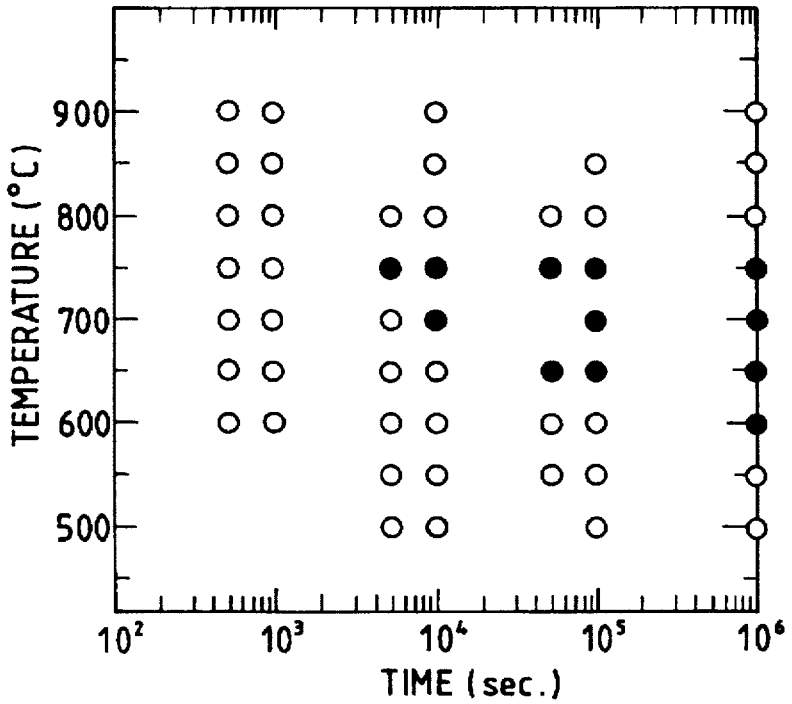
FIG. 4 is a graph showing a result of a Strauss test of a metallic material applied with a heat treatment before welding in the fourth embodiment in accordance with the present invention.

In FIG. 4, a hollow circle indicates a case where no crack is observed in the stainless steel of type SUS 316L, and a solid circle indicates a case where cracks are observed.

Here, the case of occurrence of cracks suggests decreasing of the corrosion resistivity in the vicinity of grain boundaries due to precipitation of chromium carbide in the grain boundaries.

In this embodiment, using the test results shown in FIG. 4, chromium carbide is precipitated in the grain boundaries by heating the stainless steel of type SUS 316L under the following heating condition of temperature and time before performing welding.

The heating condition of temperature and time is that the temperature is larger than and the time is larger than a temperature-time line obtained by successively connecting with straight segments between coordinate points on a temperature-time coordinate system shown in FIG. 4 of (750° C., $5\times10^3$ seconds), (700° C., $1\times10^4$ seconds), (650° C., $5\times10^4$ seconds), and (650° C., $1\times10^6$ seconds), and the temperature being smaller than 750° C.

Chromium carbide is precipitated in the grain boundaries of the stainless steel of type SUS 316L before performing welding by heating the stainless steel of type SUS 316L under such a condition described above, and then the stainless steel of type SUS 316L is welded. By doing so, occurrence of cracks can be prevented in the same manner as explained in the first embodiment.

The fifth embodiment of the present invention will be described below, referring to FIG. 5.

A stainless steel of type SUS 316L having a carbon (C) content of 0.02 wt $\%\geqq C>0.00$ wt % has been heated with varying temperature and time, and then the corrosion resistivity of the stainless steel of type SUS 316L has been studied by the Strauss testing method. The results are plotted in FIG. 5.

Figure 5:
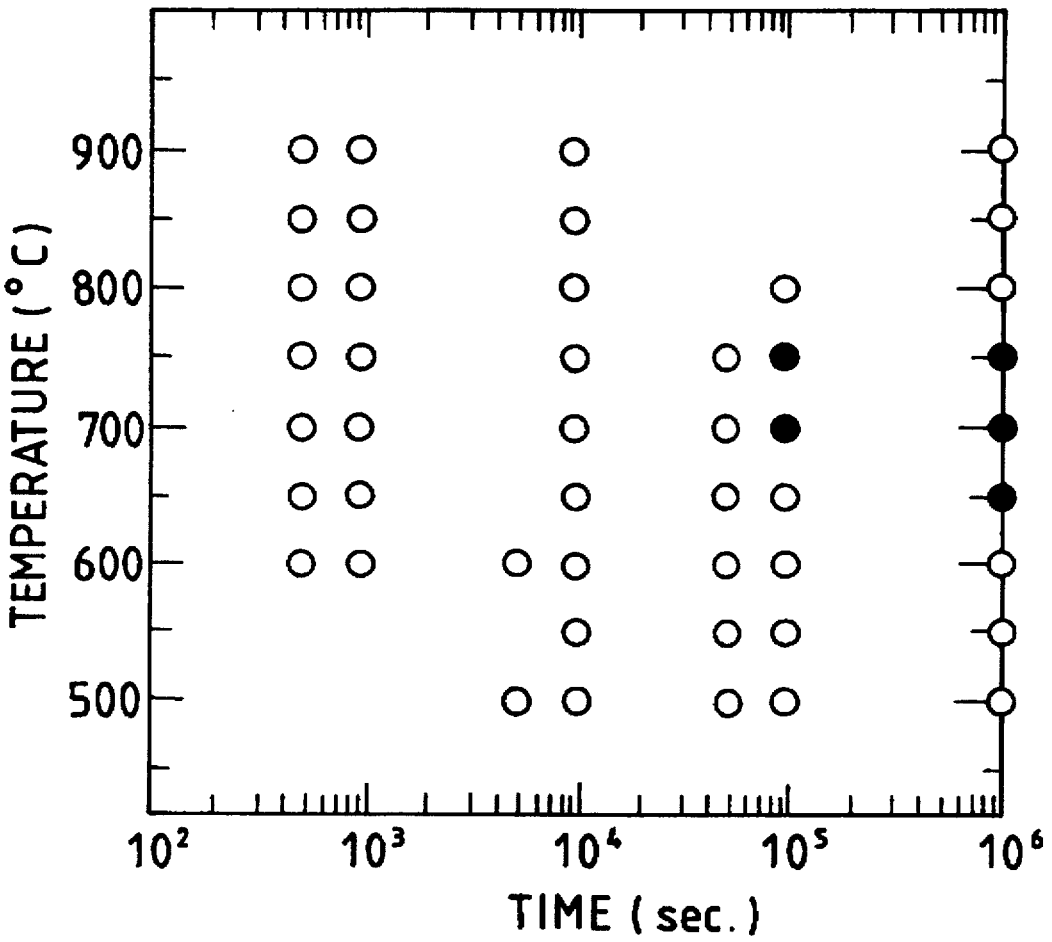
FIG. 5 is a graph showing a result of a Strauss test of a metallic material applied with a heat treatment before welding in the fifth embodiment in accordance with the present invention.

In FIG. 5, a hollow circle indicates a case where no crack is observed in the stainless steel of type SUS 316L, and a solid circle indicates a case where cracks are observed.

Here, the case of occurrence of cracks suggests decreasing of the corrosion resistivity in the vicinity of grain boundaries due to precipitation of chromium carbide in the grain boundaries.

In this embodiment, using the test results shown in FIG. 5, chromium carbide is precipitated in the grain boundaries by heating the stainless steel of type SUS 316L under the following heating condition of temperature and time before performing welding.

The heating condition of temperature and time is that the temperature is larger than and the time is larger than a temperature-time line obtained by successively connecting with straight segments between coordinate points on a temperature-time coordinate system shown in FIG. 5 of (750° C., $1\times10^5$ seconds), (700° C., $1\times10^5$ seconds) and (650° C., $1\times10^6$ seconds), and the temperature is smaller than 750° C.

Chromium carbide is precipitated in the grain boundaries of the stainless steel of type SUS 316L before performing welding by heating the stainless steel of type SUS 316L under such a condition described above, and then the stainless steel of type SUS 316L is welded. By doing so, occurrence of cracks can be prevented in the same manner as explained in the first embodiment.

The sixth embodiment and the seventh embodiment according to the present invention will be described below.

In the sixth embodiment, after completion of the welding according to any one of the first embodiment to the fifth embodiment, peening treatment is applied to the surface of heated portion including the welded portion and the vicinity of the welded portion by placing a water jet nozzle comprising an orifice for accelerating velocity of water flow and a throat and a horn-shaped nozzle connected to the throat in a position facing to the surface of heated portion and colliding a high speed jet flow containing gas bubbles from the water jet nozzle against the surface of heated portion.

By applying the peening treatment in such a manner, compressive remaining stress can be formed on the surface and in the metal layer in the vicinity of the surface of the portion of which the resistivity against corrosion is decreased by heating. Therefore, it is possible to prevent occurrence of cracks during welding and occurrence of stress corrosion cracking after welding in the austenitic stainless steel.

In the seventh embodiment, after completion of the welding according to any one of the first embodiment to the fifth embodiment, non-filler tungsten inert gas welding of low input heat or irradiation of high energy beams is applied to the surface of the welded portion and the vicinity of the welded portion of which the resistivity against corrosion is decreased.

In the portion where non-filler tungsten inert gas welding of low heat input or irradiation of high energy beams is applied, chromium carbide precipitated in the grain boundaries of the metal structure is diffused with solution treatment effect and the content of chromium carbide in the vicinity of the grain boundaries is recovered, and consequently the resistivity against corrosion can be improved.

In this moment, the non-filler tungsten inert gas welding or irradiation of high energy beams is performed at a heat input so small that movement of helium atoms becomes small enough not to cause cracks due to formation of gas bubbles.

By doing so, it is possible to prevent occurrence of cracks during welding, and to improve the resistivity in the welded portion of the austenitic stainless steel after welding against deterioration with time under a high temperature and high pressure environment and a neutron irradiation environment.

In any of the embodiments described above, in a case of welding a highly neutron-irradiated austenitic stainless steel, the portion to be welded is heated under a condition of the temperature and the time in the range described above before welding. In this moment, chromium carbide ($Cr_{23}C_6$) precipitates in the grain boundaries of the stainless steel. Helium atoms are generated in the austenitic stainless steel through nucleus conversion of Ni. However, the generated helium atoms cannot move because the helium atoms are trapped by dislocations and vacancies generated inside the grain by irradiation of neutrons. Welding is performed when the state described above is obtained. When the temperature of the stainless steel becomes above 800° C. during welding, the helium atoms start to move since the dislocations and the vacancies are recovered. However, chromium carbide has been precipitated in the grain boundary by the heat treatment before welding and helium atoms are apt to be trapped with the chromium carbide. Therefore, the size and the number of gas bubbles formed by gathering the helium atoms in the grain boundaries themselves are relatively decreased. Thus, when welding is performed to a component composed of a highly neutron-irradiated austenitic stainless steel, it is possible to prevent occurrence of cracks during welding.

In the sixth and the seventh embodiments, it is possible to prevent occurrence of cracks during welding, and, at the same time, to improve the resistivity in the welded portion of the austenitic stainless steel after welding against deterioration with time under a high temperature and high pressure environment, and a neutron irradiation environment.

What is claimed is:

1. In a method of welding a structure and a component made of stainless steel of type SUS 304 having a carbon content C of 0.08 wt %≧C>0.03 wt %, the method of welding neutron-irradiated metallic material comprising the steps of:

heating all or a portion of said structure and said component deteriorated by neutron irradiation under a condition of a temperature and a time, the temperature being larger than and the time being larger than a temperature-time line obtained by successively connecting with straight segments between coordinate points on a temperature-time coordinate system of (700° C., $1\times10^3$ seconds), (650° C., $5\times10^4$ seconds), (650° C., $1\times10^4$ seconds), (600° C., $5\times10^4$ seconds) and (600° C., $1\times10^6$ seconds), and the temperature being smaller than and the time being larger than a temperature-time line obtained by successively connecting with straight segments between coordinate points of (750° C., $1\times10^3$ seconds), (800° C., $5\times10^3$ seconds), (800° C., $1\times10^6$ seconds); and after cooling, performing welding all or the portion of said structure and said component.

2. In a method of welding a structure and a component made of stainless steel of type SUS 304 L having a carbon content C of 0.03 wt %≧C>0.02 wt %, the method of welding neutron-irradiated metallic material comprising the steps of:

heating all or a portion of said structure and component deteriorated by neutron irradiation under a condition of a temperature and a time, the temperature being larger than and the time being larger than a temperature-time line obtained by successively connecting with straight segments between coordinate points on a temperature-time coordinate system of (700° C., $5\times10^3$ seconds), (650° C., $1\times10^4$ seconds), (650° C., $5\times10^4$ seconds), (600° C., $1\times10^5$ seconds) and (600° C., $1\times10^6$ seconds), and the temperature being smaller than 700° C.; and after cooling, performing welding all or the portion of said structure and said component.

3. In a method of welding a structure and a component made of stainless steel of type SUS 304 L having a carbon content C of 0.02 wt %≧C>0 wt %, the method of welding neutron-irradiated metallic material comprising the steps of:

heating all or a portion of said structure and component deteriorated by neutron irradiation under a condition of a temperature and a time, the temperature being larger than and the time being larger than a temperature-time line obtained by successively connecting with straight segments between coordinate points on a temperature-time coordinate system of (650° C., $5\times10^4$ seconds), (700° C., $1\times10^5$ seconds) and (700° C., $1\times10^6$ seconds), and the temperature being larger than 650° C.; and after cooling, performing welding all or the portion of said structure and said component.

4. In a method of welding a structure and a component made of stainless steel of type SUS 316 L having a carbon content C of 0.03 wt %≧C>0.02 wt %, the method of welding neutron-irradiated metallic material comprising the steps of:

heating all or a portion of said structure and component deteriorated by neutron irradiation under a condition of a temperature and a time, the temperature being larger than and the time being larger than a temperature-time line obtained by successively connecting with straight segments between coordinate points on a temperature-time coordinate system of (750° C., $5\times10^3$ seconds), (700° C., $1\times10^4$ seconds), (650° C., $5\times10^4$ seconds), and (650° C., $1\times10^6$ seconds), and the temperature being smaller than 750° C.; and after cooling, performing welding all or the portion of said structure and said component.

5. In a method of welding a structure and a component made of stainless steel of type SUS 316 L having a carbon content C of 0.02 wt %≧C>0 wt %, the method of welding neutron-irradiated metallic material comprising the steps of:

heating all or a portion of said structure and component deteriorated by neutron irradiation under a condition of a temperature and a time, the temperature being larger than and the time being larger than a temperature-time line obtained by successively connecting with straight segments between coordinate points on a temperature-time coordinate system of (750° C., $1\times10^5$ seconds), (700° C., $1\times10^5$ seconds) and (650° C., $1\times10^6$ seconds), and the temperature being smaller than 750° C.; and after cooling, performing welding all or the portion of said structure and said component.

6. A method of welding the neutron-irradiated metallic material according to any one of claim 1 to claim 5, wherein, after completion of the welding, pressure is applied to the surface of heated portion including the welded portion and the vicinity of said welded portion to add compressive remaining stress or decrease tensile remaining stress.

7. A method of welding the neutron-irradiated metallic material according to claim 6, wherein said pressure applying is performed by placing a water jet nozzle in a position facing to said surface of heated portion and colliding a high speed jet flow containing gas bubbles from said water jet nozzle against said surface of heated portion.

8. A method of welding the neutron-irradiated metallic material according to any one of claim 1 to claim 5, wherein, after completion of the welding, the surface of heated portion including the welded portion and the vicinity of said welded portion undergoes solution treatment by reheating to diffuse chromium carbide precipitated in the grain boundaries of the metal structure.

9. A method of welding the neutron-irradiated metallic material according to claim 8, wherein said reheating is performed through non-filler tungsten inert gas welding or irradiation of high energy beams.

* * * * *